US009377171B2

(12) United States Patent
Larsen et al.

(10) Patent No.: US 9,377,171 B2
(45) Date of Patent: Jun. 28, 2016

(54) LENS SYSTEM AND METHOD FOR ELIMINATING SUN FOCUSING THERMAL EFFECTS IN LAMPS

(71) Applicant: GM GLOBAL TECHNOLOGY OPERATIONS LLC, Detroit, MI (US)

(72) Inventors: Michael K. Larsen, Troy, MI (US); Alvin T. Pieczynski, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 155 days.

(21) Appl. No.: 14/449,227

(22) Filed: Aug. 1, 2014

(65) Prior Publication Data

US 2016/0033104 A1 Feb. 4, 2016

(51) Int. Cl.

| | |
|---|---|
| ***F21V 5/00*** | (2015.01) |
| ***F21S 8/10*** | (2006.01) |
| *F21W 101/00* | (2006.01) |

(52) U.S. Cl.

CPC ..... *F21S 48/31* (2013.01); *F21W 2101/00* (2013.01)

(58) Field of Classification Search

CPC ..... F21S 48/00; F21S 48/10; F21S 48/20; F21S 48/30; F21S 48/31; F21W 2101/00; G02B 1/10; G02B 1/12

USPC ..... 362/520, 293

See application file for complete search history.

(56) References Cited

U.S. PATENT DOCUMENTS

| | | | | |
|---|---|---|---|---|
| 4,069,630 | A * | 1/1978 | Chess | E06B 3/6715 428/34 |
| 4,829,210 | A * | 5/1989 | Benson | H01K 1/34 313/113 |
| 5,743,632 | A * | 4/1998 | Carl | F21S 48/335 362/268 |
| 8,253,840 | B2 * | 8/2012 | Hung | B32B 15/015 348/335 |
| 2007/0206166 | A1 * | 9/2007 | Wu | G02B 7/102 353/102 |

* cited by examiner

*Primary Examiner* — Ali Alavi

(74) *Attorney, Agent, or Firm* — Quinn Law Group, PLLC

(57) ABSTRACT

An infrared energy reflecting lens system for a lamp subjectable to sunlight is provided. The lens system includes a lens having an exterior surface and a dichroic coating on the exterior surface of the lens so that at least a portion of the infrared energy content of sunlight is reflected from entering the lens.

14 Claims, 2 Drawing Sheets

LENS SYSTEM AND METHOD FOR ELIMINATING SUN FOCUSING THERMAL EFFECTS IN LAMPS

TECHNICAL FIELD

This disclosure relates to a lens system for eliminating sun focusing thermal effects in a lamp and a method for the same.

BACKGROUND

A vehicle typically includes a number of lamps, including headlamps, fog lamps, tail lamps, and other lamps for lighting, signaling, and visibility. The vehicle lamps include an internal light source and often include a projection system having a lens for projecting the light from the internal light source. The lens in the projection system may transmit, redirect, and focus the infrared energy content of sunlight received from the outside environment onto a surface of the lamp that is near or adjacent to the lens, causing thermal effects including diminished aesthetic appearance. This may be avoided by either blocking the incoming sunlight or by increasing the thermal resistance of the surface which receives the focused sunlight. Blocking the incoming sunlight may not be feasible or aesthetically pleasing depending on the configuration of the lamp. Increasing the thermal resistance of the adjacent surface may increase costs. It may be beneficial for the lens to reflect the infrared energy content of sunlight received from the outside environment.

SUMMARY

An infrared energy reflecting lens system for a lamp subjectable to sunlight is provided. The lens system includes a lens having an exterior surface and a dichroic coating on the exterior surface of the lens so that at least a portion of the infrared energy content of sunlight is reflected from entering the lens.

A vehicle is also provided. The vehicle is subjectable to sunlight and includes a lamp having a projection system including a lens having an exterior surface and a dichroic coating on the exterior surface of the lens so that at least a portion of the infrared energy content of sunlight is reflected from entering the lens.

A method is provided for preventing the infrared energy in sunlight from thermally affecting a surface adjacent to a lens of a vehicle lamp. The method includes coating an exterior surface of the lens with a dichroic coating to reflect at least a portion of the infrared energy content of sunlight.

The infrared light reflecting lens system, the vehicle, and the method may enable the lens in the lamp to reflect the infrared energy content of sunlight received from the outside environment.

The above features and advantages and other features and advantages of the present teachings are readily apparent from the following detailed description of the best modes for carrying out the present teachings when taken in connection with the accompanying drawings.

DETAILED DESCRIPTION

Figure 1:
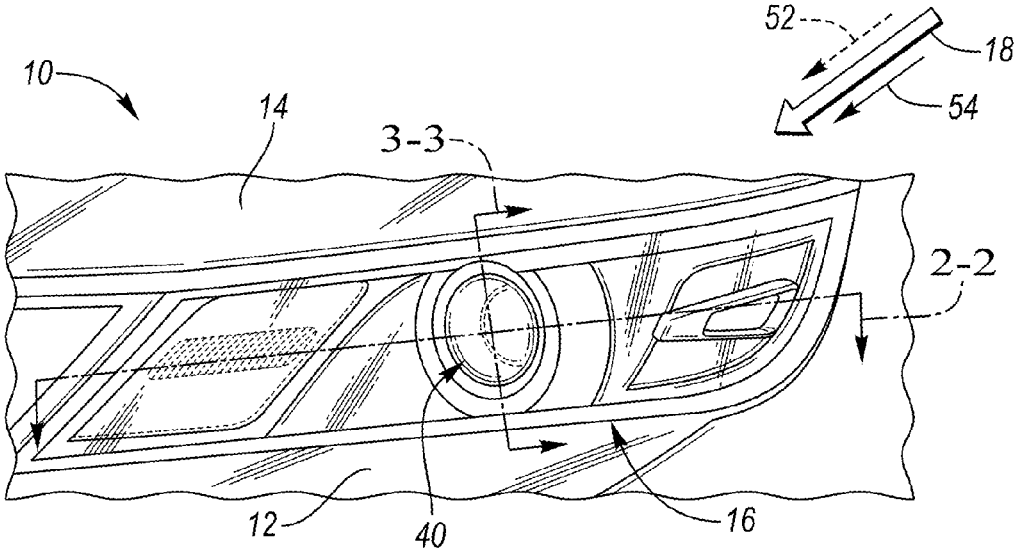
FIG. 1 is a fragmentary schematic perspective illustration of a vehicle having a lamp including an infrared light reflecting lens system.

Referring to the drawings, wherein like reference numbers refer to like components throughout the views, FIG. 1 shows a vehicle 10 subjectable to sunlight 18. The vehicle 10 may include a fascia 12, a hood 14, and a lamp 16. The lamp 16 may be a headlamp, as shown, or may be another type of vehicle lamp, including but not limited to, a fog lamp, a brake lamp, a tail lamp, a turn signal lamp, and a reverse lamp. The sunlight 18 may strike the vehicle 10 and the lamp 16 at various angles depending on the orientation of the vehicle and the time of day. The sunlight 18 includes infrared energy content 52 and visible light content 54.

Figure 2:
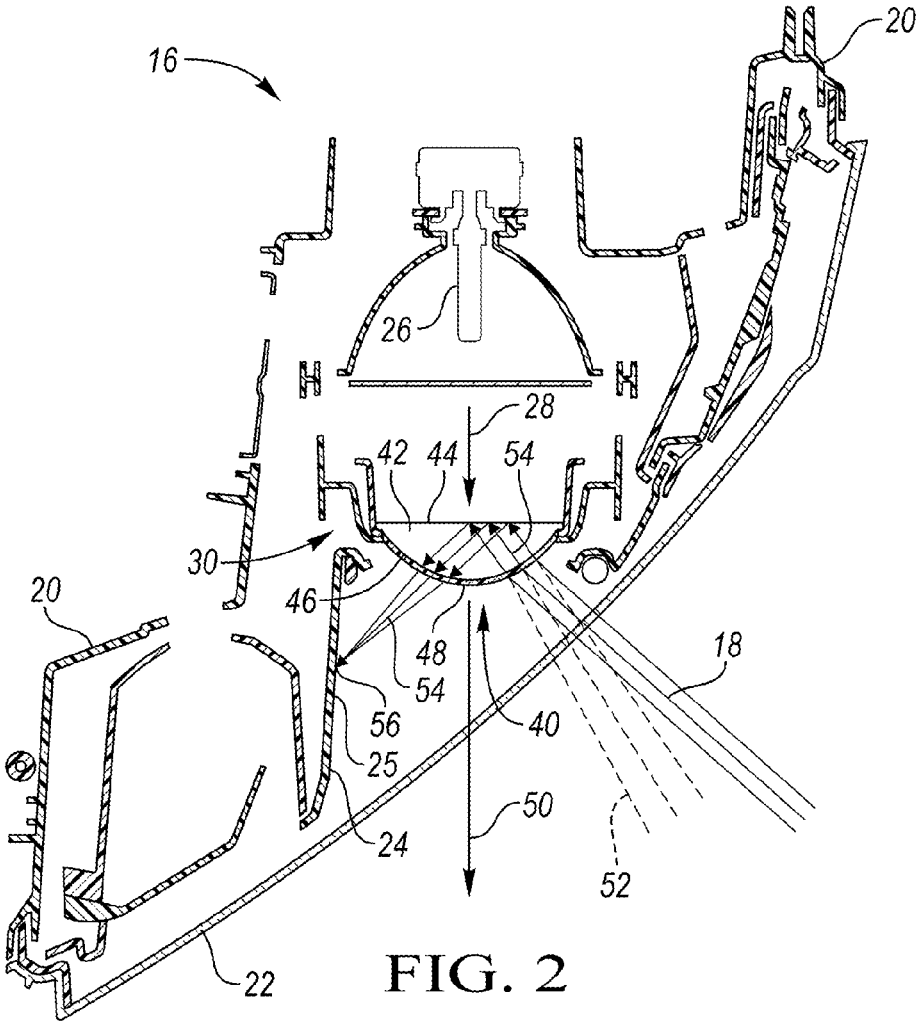
FIG. 2 is a schematic cross-sectional illustration of the lamp of FIG. 1 taken at line 2-2 in FIG. 1.

Referring now to FIG. 2, the lamp 16 may include a housing 20 for supporting and positioning the components of the lamp 16, for protecting the components of the lamp 16 from the surrounding conditions, and for facilitating attachment of the lamp 16 to the vehicle 10, among other functions. The housing 20 may be made of a non-metallic material. The lamp 16 may include a transparent outer lens 22 attached to the housing 20 for protecting the components of the lamp 16 from the surrounding conditions and for transmitting light into and out of the lamp 16, among other functions. The outer lens 22 may be made of a transparent non-metallic material including, but not limited to, a plastic or a glass material. The lamp 16 may include a bezel 24 attached to the housing 20 for enhancing the aesthetic appearance of the lamp 16, among other functions. The bezel 24 may have a surface 25. The bezel 24 may be made of a non-metallic material and may have a one or more of a variety of surface 25 colors, treatments, and coatings. The lamp 16 includes an internal light source 26 attached to the housing 20. The internal light source 26 emits light 28, which includes at least a part of the visible light portion of the electromagnetic energy spectrum.

The lamp 16 includes an infrared energy reflecting lens system 40. The lamp 16 may include a projection system 30 for projecting the light 28 emitted from the internal light source 26. The projection system 30 may have an infrared energy reflecting lens system 40. The infrared energy reflecting lens system 40 includes a lens 42 and a dichroic coating 48. The lens 42 has interior surface 44 and an exterior surface 46 and is for transmitting and refracting the light 28 emitted from the internal light source 26 to create a projected light 50. Projection systems are commonly used in the automotive industry to create low beam, high beam, and other projected light 50 beam patterns from a lamp 16. Other projected light 50 beam patterns include, but are not limited to, fog lamp, daytime running lamp, adaptive driving, and cornering lamp beam patterns. The projection system 30 utilizes the lens 42 to create the projected light 50 beam pattern similar to how a movie projector uses a projection lens to create an image on a movie screen.

The lens 42 may be a condensing or projection lens, as shown. A condensing or projection lens is an optical lens which renders a divergent beam from a point source into a parallel or converging beam in order to illuminate an object or an area. The lens 42 may be made of a transparent non-metal material including, but not limited to, a plastic or a glass material.

The lens 42 may also transmit, redirect, and focus the sunlight 18 received from the outside environment onto the surface 25 or onto other surfaces adjacent to the projection system 30. This is similar to how a magnifying glass may be used to focus sunlight onto a surface to greatly increase heat in a local area. Focusing the sunlight 18 received from the outside environment onto the surface 25 or onto other surfaces adjacent to the lens 42 may cause thermal effects, including diminished aesthetic appearance of the surface 25 or of other surfaces adjacent or near to the lens 42. Transmit is defined as allowing electromagnetic energy to pass through, as when visible light passes through a transparent material, such as clear, uncoated glass. The electromagnetic energy that is allowed to pass through may be limited to a portion of the electromagnetic spectrum.

The dichroic coating 48 is on the exterior surface 46 of the lens 42 so that at least a portion of the infrared energy content 52 of sunlight 18 is reflected from entering the lens 42. The dichroic coating 48 prevents the lens 42 from transmitting, redirecting, and focusing at least a portion of the infrared energy content 52 of the sunlight 18 onto the surface 25 of the bezel 24 or onto any other nearby or adjacent surfaces of the lamp 16 or the vehicle 10. The dichroic coating 48 transmits at least a portion of the visible light content of the light 28 from the internal light source 26. The dichroic coating 48 may transmit at least a portion of the visible light content 54 of the sunlight 18.

The dichroic coating 48 is an optical coating or filter that is applied to the lens 42. The dichroic coating 48 is designed to reflect at least a portion of the infrared electromagnetic energy content 52 of sunlight 18. The dichroic coating 48 may be designed to transmit at least a portion of the visible electromagnetic energy content 54 of sunlight 18. The dichroic coating 48 may include multiple layers of optical coatings with different refractive indexes. The multiple layers of the dichroic coating 48 may be applied to the lens 42 by vacuum deposition.

Figure 3:
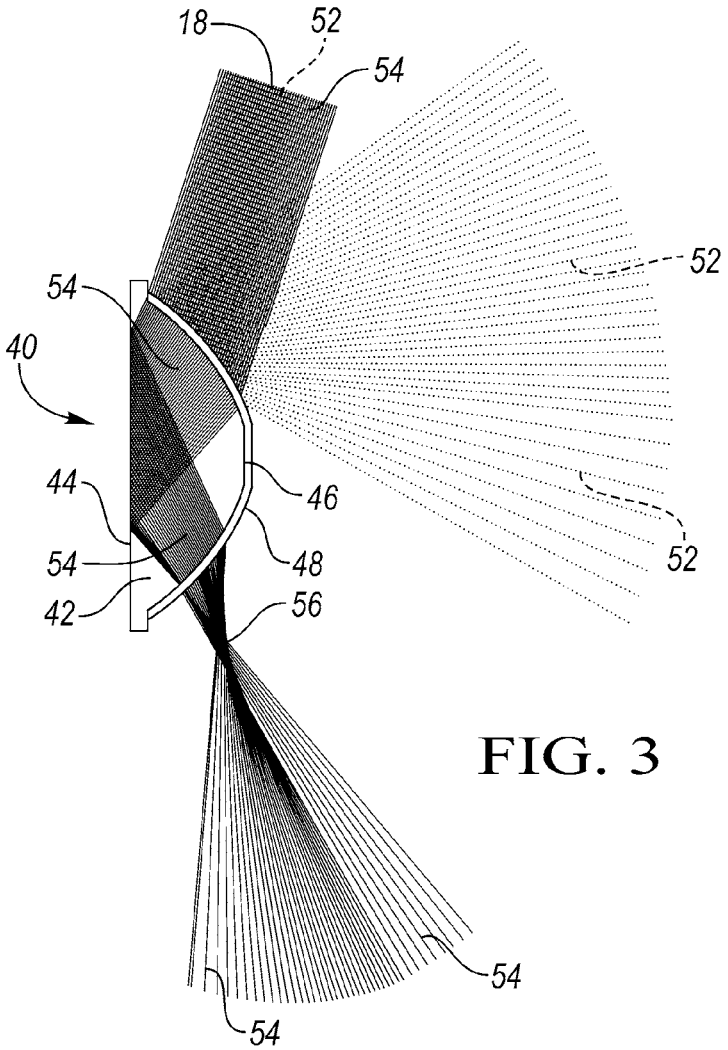
FIG. 3 is a schematic cross-sectional illustration of the infrared light reflecting lens of FIG. 1 taken at line 3-3 of FIG. 1.

Referring now to FIG. 3, the interaction of the sunlight 18 with the infrared energy reflecting lens system 40 is shown in greater detail. The incoming sunlight 18 includes both infrared energy content 52 and visible light content 54. The infrared energy content 52 is reflected by the dichroic coating 48 and is dispersed away from the infrared energy reflecting lens system 40 and the lamp 16. The visible light content 54 is transmitted by the dichroic coating 48 and may be redirected and focused. However, the redirected and focused visible light content 56 of the sunlight 18 has no infrared energy content 52 and thus will not cause heating of the surfaces adjacent or near to the infrared energy reflecting lens system 40.

Figure 4:
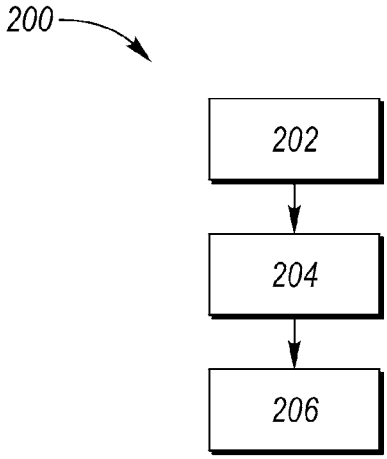
FIG. 4 is flow chart of a method for preventing the infrared energy in sunlight from thermally affecting a surface adjacent to a lens of a vehicle lamp.

Referring now to FIG. 4, a method 200 for preventing the infrared energy content 52 of sunlight 18 from thermally affecting a surface 25 adjacent to a lens 42 of a vehicle 10 lamp 16 includes coating 202 an exterior surface 46 of the lens 42 with a dichroic coating 48 to reflect at least a portion of the infrared energy content 52 of sunlight 18. The method 200 may include reflecting 204 all of the infrared energy content 52 of sunlight 18. The method 200 may include transmitting 206 at least a portion of the visible light from an internal light source 26 in the vehicle lamp 16. Transmitting 206 may include transmitting at least a portion of the visible light content 54 of sunlight 18.

While the best modes for carrying out the many aspects of the present teachings have been described in detail, those familiar with the art to which these teachings relate will recognize various alternative aspects for practicing the present teachings that are within the scope of the appended claims.

The invention claimed:

1. An infrared energy reflecting lens system for a lamp subjectable to sunlight, comprising:

a lens having an exterior surface; and a dichroic coating on the exterior surface of the lens so that at least a portion of the infrared energy content of sunlight is reflected from entering the lens.

2. The infrared energy reflecting lens system of claim 1, wherein the dichroic coating transmits visible light.

3. The infrared energy reflecting lens system of claim 1, wherein the lens is a condensing lens.

4. The infrared energy reflecting lens system of claim 1, wherein the lens is a projection system lens of a vehicle lamp.

5. The infrared light reflecting lens system of claim 3, wherein the lens is a projection system lens of a vehicle lamp.

6. A vehicle subjectable to sunlight, comprising:

a lamp having:

a projection system including a lens having an exterior surface; and a dichroic coating on the exterior surface of the lens so that at least a portion of the infrared energy content of sunlight is reflected from entering the lens.

7. The vehicle of claim 6, wherein the lamp includes an internal light source; and wherein the dichroic coating transmits at least a portion of the visible light from the internal light source.

8. The vehicle of claim 7, wherein the dichroic coating transmits at least a portion of the visible light content of sunlight.

9. The vehicle of claim 7, wherein the lens is a condensing lens.

10. The vehicle of claim 7, wherein the lamp includes a bezel; and wherein the dichroic coating prevents at least a portion of the infrared energy content of sunlight from passing through the lens and onto the bezel.

11. A method for preventing the infrared energy content of sunlight from thermally affecting a surface adjacent to a lens of a vehicle lamp, comprising:

coating an exterior surface of the lens with a dichroic coating to reflect at least a portion of the infrared energy content of sunlight.

12. The method of claim 11, further comprising reflecting all of the infrared energy content of sunlight.

13. The method of claim 11, further comprising transmitting at least a portion of the visible light from an internal light source in the vehicle lamp.

14. The method of claim 13, wherein transmitting includes transmitting at least a portion of the visible light content of sunlight.

* * * * *